United States Patent [19]

Huenefeld

[11] Patent Number: 4,885,860

[45] Date of Patent: Dec. 12, 1989

[54] YARD SIGN

[75] Inventor: Robert C. Huenefeld, Cincinnati, Ohio

[73] Assignee: Dee Sign Co., Cincinnati, Ohio

[21] Appl. No.: 247,731

[22] Filed: Sep. 22, 1988

[51] Int. Cl.[4] ..... G09F 15/00

[52] U.S. Cl. ..... 40/606

[58] Field of Search ..... 40/606, 607, 610, 645

[56] References Cited

U.S. PATENT DOCUMENTS

| | | | |
|---|---|---|---|
| D 265,746 | 8/1982 | Robillard | D20/3 |
| 1,649,249 | 11/1927 | Newman | 40/607 |
| 1,709,041 | 4/1929 | Schutt | 40/536 |
| 1,902,189 | 3/1933 | Schutt | 40/607 |
| 2,022,160 | 11/1935 | Sorensen et al. | 40/607 |
| 2,501,044 | 3/1950 | Gianelloni, Jr. | 40/533 |
| 2,552,745 | 5/1951 | Stanely, Sr. et al. | 40/607 |
| 2,939,236 | 6/1960 | Stein | 40/610 |
| 4,232,467 | 11/1980 | Steward | 40/607 |
| 4,233,769 | 11/1980 | Archer | 40/607 |
| 4,318,238 | 3/1982 | MacArle, Jr. | 40/607 |
| 4,343,449 | 8/1982 | Osthus | 248/156 |
| 4,524,533 | 6/1985 | Still, Jr. | 40/607 |
| 4,660,310 | 4/1987 | Farmer | 40/607 |
| 4,667,829 | 5/1987 | Edmund-White | 206/575 |

OTHER PUBLICATIONS

Sept. 1976, Newspaper Type Advertising Brochure, Kennedy Real Estate Signs, Inc., Roseland, LA.

Jul. 15, 1977, advertising flyer, Phil Irwin Advertising, Indianapolis, IN.

Jul. 1, 1979, advertising brochure, Active Sign Co., Gary, IN.

*Primary Examiner*—Robert P. Swiatek

*Assistant Examiner*—Cary E. Stone

*Attorney, Agent, or Firm*—Wood, Herron & Evans

[57] ABSTRACT

A yard sign having two display panels, each of pan shaped configuration and adapted to nest one within the other so that a cavity is formed therebetween. An H-shaped support frame is positioned within the nested panels with only that portion of the frame's legs that extend below the frames's crossbar being located exteriorly of the display panels. The top edges of the H-frame's legs abut the nested display panels' top edge to prevent the display panels from sliding down on the support frame, and the support frame's crossbar abuts the nested display panel's bottom edge to prevent the pans from sliding up on the support frame. The legs are spaced apart one from the other a distance sufficient to minimize twisting of the display panels on the support frame relative to the sign's vertical center axis.

6 Claims, 1 Drawing Sheet

YARD SIGN

This invention relates to displays. More particularly, this invention relates to a display sign of the type especially useful as a yard sign.

Yard signs are very well known to the prior art. Real estate brokers commonly make use of yard signs. When a residential or commercial property is to be sold, the broker stakes one or more signs in the yard of the property so as to inform passers-by that the property is for sale. And there are any number of different structures known to the prior art which can and have been used as real estate yard signs.

It has been a primary objective of this invention to provide a display sign, and particularly a display sign adapted for use as a real estate yard sign, that is of simple construction and relatively lightweight. Simple construction is desirable so as to minimize the cost of the yard sign in the first instance. And lightweight is desirable because yard signs are most often placed on the property by a broker who is dressed in business clothes, and who often is a woman.

In accord with this objective, the display sign of this invention includes two display panels, each of pan shaped configuration and adapted to nest one within the other so that a cavity is formed therebetween. An H-shaped support frame is positioned within the nested panels with only that portion of the frame's legs that extend below the frame's crossbar being located exteriorly of the display panels. The top edges of the H-frame's legs abut the nested display panels' top edge to prevent the display panels from sliding down on the support frame, and the support frame's crossbar abuts the nested display panels' bottom edge to prevent the pans from sliding up on the support frame. The legs are spaced apart one from the other a distance sufficient to minimize twisting of the display panels on the support frame relative to the sign's vertical center axis.

Other objectives and advantages of this invention will be more apparent in accordance with the following detailed description including the drawings in which.

Figure 1:
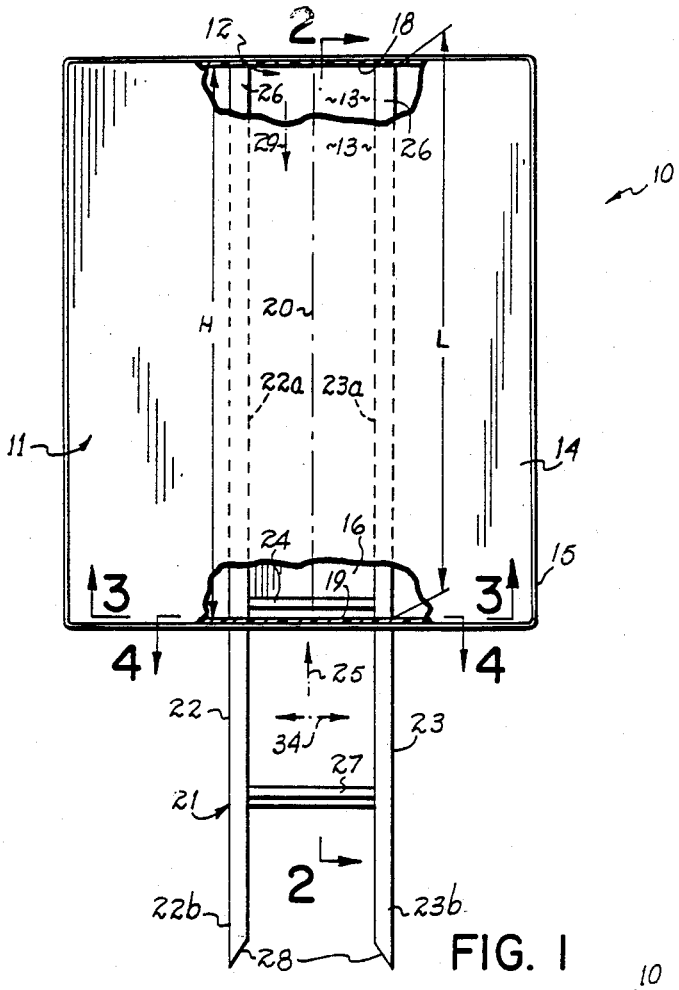
FIG. 1 is a plan view of one face of a display sign in accord with the principles of this invention.
Figure 2:
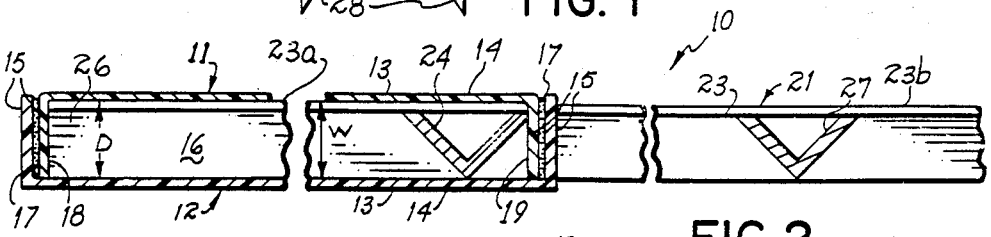
FIG. 2 is a cross sectional view taken along line 2—2 of FIG. 1.

The display sign 10 in accord with the principles of this invention, as shown in FIG. 1, includes two display panels 11, 12. Each of the display panels 11, 12 is in the form of a pan 13 having a major face 14, and an upstanding rim or flange 15 that extends around the periphery of that face. These pans 13 are specially sized relative one to the other so that they can nest one within the other so as to create a cavity 16 therebetween. The pans are held in assembled or nested relation by gluing the pan flanges one to the other as particularly shown at 17 in FIG. 2. It will be understood to those skilled in the art that while the display panels 11, 12 shown are of generally rectangular configuration, they may be of substantially any geometrical configuration. When so nested, note that the display panels have an interior depth D that extends between the interior surfaces of the two display panels, main faces 14, and an interior height H which extends between the interior top 18 and bottom 19 edges, respectively, of the interiorly nested display panels. Note also that the nested display panels define a longitudinal axis 20 for the sign.

An H-shaped support frame 21 is provided to cooperate with the two display panels 11, 12. The H-shaped support frame 21 is comprised of two vertical legs 22, 23 that are parallel one to the other, and a crossbar 24. Note particularly that, when positioned within the nested display panel pans 13, the crossbar 24, and that portion *22a, 23a* of each leg extending above the crossbar, are all located interiorly of the nested display panel pans. Further, that portion *22b, 23b* of each leg extending below the crossbar 24 is located exteriorly of the nested display panel pans 13. Now also particularly note that, when assembled, the crossbar 24 of the H-shaped support frame abuts against the interior bottom edge 19 of the nested display panel pans 13 to prevent the pans from sliding up on the support frame 21 in a direction shown by phantom arrow 25. Further, the top end 26 of each frame leg 22, 23 abuts against the interior top edge 18 of the nested display panel pans 13 to prevent the pans from sliding down on the support frame 21 in a direction shown by phantom arrow 29. In this regard, therefor, the length L of each leg 22, 23 of the H-shaped support frame 21 within the nested display panel pans 13 is substantially equal to the interior height H of the nested display panel pans when a rectangular display panel configuration is used as illustrated.

A footbar 27 is interposted between, and firmly connected to, that portion *22b, 23b* of each leg which extends exteriorly of the display panel pans 13. The footbar 27 is provided for use in planting the yard sign in the ground. In this regard, a user's hands simply hold the sign upright with the pointed ends 28 of the legs against ground. The user then places one foot on the foot bar 27 while standing on the ground with the other foot, and pushes the H-frame legs 22, 23 into the ground with that foot on the crossbar.

Figure 3:
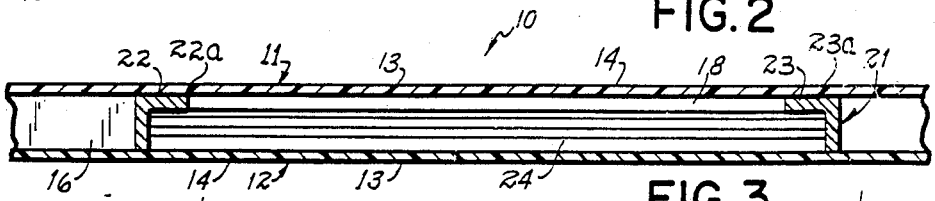
FIG. 3 is a cross sectional view taken along line 3—3 of FIG. 1.
Figure 4:
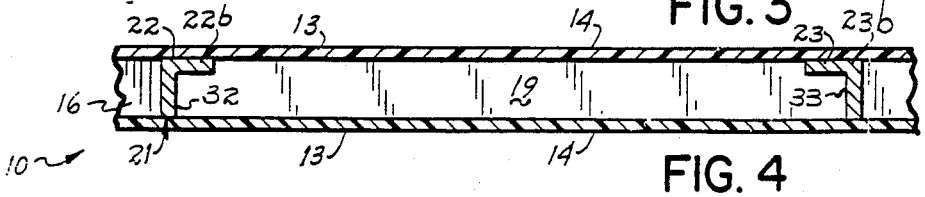
FIG. 4 is a cross sectional view taken along line 4—4 of FIG. 1.

As is apparent from FIG. 4, the bottom edge 19 of the nested display panel pans 13 includes two spaced ports 32, 33 each of which is sized and configured to cooperate with one 22 or 23 of the support frame's two legs so as to prevent substantial side to side motion (as shown by phantom arrow 34) of the display panels 11, 12 relative to the frame 21. Note particularly, as shown in FIG. 3, that each leg 22, 23 is of a right angular configuration, and note particularly as shown in FIG. 4 that each port 32, 33 is of a mating right angular configuration. The size and configuration of each port 32, 33 relative to the size and configuration of the cross section of each leg 22, 23 is carefully controlled so that one interfits with the other when the sign is completely assembled. And it is this interfit which prevents the substantial side to side motion 34 of the display panels 11, 12 relative to the frame.

Therefore, the assembled sign of this invention can be fabricated with display panels 11, 12 of very lightweight plastic material and with an H-shaped support frame 21 of relatively lightweight angle metal material. The interfit of the H-shaped support frame 21 with the sign's display panels 11, 12 is such that the sign cannot slide up 25 or down 29 relative to the support frame, and cannot slide from side to side 34 on that support frame, all for the reasons previously explained. Further, the H-shaped support frame 21 is trapped within and between the two display panels 11, 12 since the cavity depth D between the display panels is not substantially greater than the width W of the frame's angle pieces. And the frame 21 is held in assembly with the display panels 11, 12 by virtue of being trapped between those display panel pans' 13 since the pans are glued together around the circumferential edge thereof.

Having described in detail the preferred embodiment of my invention, what I desire to claim and protect by Letters Patent is:

1. A sign comprising two display panels, each of said display panels having a display surface, each of said display panels being in the form of a pan, said pans being nested together one within the other so that a cavity is provided between said display surfaces thereof, an H-shaped support frame comprising two legs and a crossbar, said crossbar and that portion of each leg extending above said crossbar being located interiorly of said nested display panel pans, that portion of each leg extending below said crossbar being located exteriorly of said nested display pans, and the top end of at least one leg being butted against the interior top edge of said nested pans to prevent said pans from sliding down on said support frame and at least a portion of said crossbar being butted against the interior bottom edge of said nested pans to prevent said pans from sliding up on said support frame, port structure defined in the bottom edge of said nested pans, said port structure being sized and configured to cooperate with said two legs so as to prevent substantial side to side motion of said panels relative to said frame, and restraining means applied to the mating edges of said display panel pans to hold said display panels in nested configuration, said H-shaped support frame being trapped between said display panels so that said H-shaped support frame need not be fixed to either of said display panels by separate fasteners.

2. A sign as set forth in claim 1, said legs being spaced one from the other a sufficient distance to minimize twisting, of said nested display panels, pans relative to the sign's vertical axis.

3. A sign as set forth in claim 1, said sign comprising a footbar connected between those leg portions that are exterior of said nested pans, said footbar permitting said sign to be driven into the ground by a person's foot while holding the sign upright with a person's hand.

4. A sign as set forth in claim 1, said port structure comprising two separate ports in the sign's bottom edge, each leg cooperating with one of said ports.

5. A sign as set forth in claim 4, each of said legs being generally right angular in cross section and each of said ports being generally right angular in configuration.

6. A sign as set forth in claim 1, the width of each leg of said H-shaped support frame being about equal to but not greater than the interior depth between said nested pans.

* * * * *